US011408085B2

(12) United States Patent
Wachter

(10) Patent No.: US 11,408,085 B2
(45) Date of Patent: Aug. 9, 2022

(54) GALVANIC NICKEL OR NICKEL ALLOY ELECTROPLATING BATH FOR DEPOSITING A SEMI-BRIGHT NICKEL OR SEMI-BRIGHT NICKEL ALLOY COATING

(71) Applicant: Atotech Deutschland GmbH, Berlin (DE)

(72) Inventor: Philipp Wachter, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 17/434,811

(22) PCT Filed: Apr. 14, 2020

(86) PCT No.: PCT/EP2020/060455
§ 371 (c)(1),
(2) Date: Aug. 30, 2021

(87) PCT Pub. No.: WO2020/212346
PCT Pub. Date: Oct. 22, 2020

(65) Prior Publication Data

US 2022/0098747 A1 Mar. 31, 2022

(30) Foreign Application Priority Data

Apr. 15, 2019 (EP) ..... 19169306

(51) Int. Cl.
*C25D 3/18* (2006.01)
*C25D 3/16* (2006.01)

(52) U.S. Cl.
CPC ..... *C25D 3/18* (2013.01); *C25D 3/16* (2013.01)

(58) Field of Classification Search
None
See application file for complete search history.

(56) References Cited

U.S. PATENT DOCUMENTS

| | | | | |
|---|---|---|---|---|
| 3,718,549 A | 2/1973 | Du Rose et al. | | |
| 3,719,568 A | 3/1973 | Klein et al. | | |
| 5,164,069 A | 11/1992 | Cerwonka | | |
| 2016/0053395 A1* | 2/2016 | Schulz | C25D 3/562 205/259 | |

FOREIGN PATENT DOCUMENTS

| | | | | |
|---|---|---|---|---|
| CN | 108950617 A | 12/2018 | | |
| DE | 19610361 A1 | 9/1997 | | |
| EP | 2801640 A1 | 11/2014 | | |
| EP | 2852698 B1 | 10/2016 | | |
| GB | 1208886 | 10/1970 | | |
| WO | WO-2018015168 A1 * | 1/2018 | C25D 3/16 | |
| WO | 2018234229 A1 | 12/2018 | | |

OTHER PUBLICATIONS

PCT/EP2020/060455; International Search Report and Written Opinion of the International Searching Authority dated May 29, 2020.

* cited by examiner

*Primary Examiner* — Wojciech Haske
(74) *Attorney, Agent, or Firm* — Renner, Otto, Boisselle & Sklar, LLP

(57) ABSTRACT

Galvanic nickel or nickel alloy electroplating bath for depositing a semi-bright nickel or semi-bright nickel alloy coating in which the electroplating bath includes at least one compound having the general formula (1) and/or a salt thereof (I)

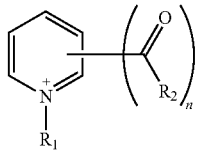

wherein $R_1$=$C_1$-$C_{18}$ hydrocarbon moiety comprising a $SO_3^-$ group, a carboxylic group, or an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_3$-$C_8$ hydrocarbon moiety, or $C_3$-$C_8$ hydrocarbon moiety wherein at least one carbon atom is substituted by a heteroatom;

n=1-3; and wherein the electroplating bath further comprises at least one acetylenic compound and chloral hydrate.

12 Claims, No Drawings

GALVANIC NICKEL OR NICKEL ALLOY ELECTROPLATING BATH FOR DEPOSITING A SEMI-BRIGHT NICKEL OR SEMI-BRIGHT NICKEL ALLOY COATING

This application is a national phase of International Application No. PCT/EP2020/060455 filed 14 Apr. 2020, which claims priority to European Patent Application No. 19169306.8 filed 15 Apr. 2019, the entireties of which are hereby incorporated by reference.

FIELD OF THE INVENTION

The present invention relates to a galvanic nickel or nickel alloy electroplating bath for depositing a semi-bright nickel or semi-bright nickel alloy coating on an electrically conductive work piece; and a method therefore. The invention is further generally directed to the use of such a galvanic nickel or nickel alloy electroplating bath for depositing a semi-bright nickel or semi-bright nickel alloy coating by conducting the method of the present invention.

BACKGROUND OF THE INVENTION

Bright nickel electroplating baths are used in the automotive, electrical, appliance, hardware and other industries. The most important functions of bright nickel plating are as an undercoating for chromium plating, helping finishers achieve a smooth bright finish and providing a significant amount of corrosion protection.

For decorative plated parts that need a high level of basis metal corrosion protection, semi-bright nickel deposits are almost always used in conjunction with subsequent deposits of bright nickel and chromium. The semi-bright nickel deposit is typically between about 60 and 70 percent of the total nickel deposited on the part, which offers the highest level of basis metal corrosion protection with the lowest total nickel thickness and the best appearance.

Typically, the work piece, in particular the metal substrate, is covered by a semi-bright nickel deposit, wherein the semi-bright nickel deposit is covered by a bright nickel deposit and wherein the bright nickel deposit is covered by a chromium outer deposit.

The most common nickel electroplating bath is a sulfate bath known as a Watts bath. In addition, in order to achieve bright and lustrous appearance of the nickel plating deposit, organic and inorganic agents (brighteners) are often added to the electrolyte. The types of added brighteners and their concentrations determine the appearance of the nickel deposit, i.e., brilliant, bright, semi-bright, satin, etc.

Traditionally, coumarin has been used to obtain a high-leveling, ductile, semi-bright and sulfur-free nickel deposit from a Watts nickel bath. However, coumarin-free solutions are now available. A semi-bright nickel finish is semi-lustrous, as the name implies, but it was specifically developed for its ease of polishing and buffing. In the alternative, if subsequently bright nickel is plated, buffing can be eliminated. Brightness and smoothness are dependent on operating conditions.

One of the reasons that semi-bright nickel finishes are so easily buffed and/or polished is that the structure of the deposit is columnar, whereas the structure of a bright nickel finish is plate-like (lamellar). However, the structure of the deposit can be changed with various additives, a change in pH, current density or an increase in solution agitation, which is not a problem unless it affects properties of the deposit such as internal stress.

Internal stress of the plated nickel deposit can be compressive or tensile. Compressive stress is where the deposit expands to relieve the stress. In contrast, tensile stress is where the deposit contracts. Highly compressed deposits can result in blisters, warping or cause the deposit to separate from the work piece, while deposits with high tensile stress can also cause warping in addition to cracking and reduction in fatigue strength.

The use of coumarin as an additive in nickel electroplating baths, especially semi-bright nickel processes, to produce ductile, lustrous deposits with excellent leveling is well known. High concentrations of coumarin in the bath gives the best leveling results on one side, but such high coumarin concentrations also result on the other side in a high rate off formation of detrimental breakdown or degradation products. These degradation products are objectionable in that they can cause uneven, dull gray areas that are not easily brightened by a subsequent bright nickel deposit, they can reduce the leveling obtained from a given concentration of coumarin in the electroplating bath, and they can reduce the beneficial physical properties of the nickel deposits.

The use of various additives, such as formaldehyde and chloral hydrate has also been suggested to help overcome the undesirable effects of the coumarin degradation products. However, the use of such additives has certain limitations because even moderate concentrations of these materials not only increase the tensile stress of the nickel electrodeposits, but also significantly reduce the leveling action of the coumarin.

Even when since decades plating suppliers have proposed many bath formulations which claim to level as well as a coumarin bath, up to now, very few of these bath formulations have met all of the necessary criteria.

As explained above, while the leveling of coumarin is exceptional coumarin has a disagreeable odor, breaks down and forms harmful degradation products, and these degradation products can only be removed by batch carbon treatments of the electroplating bath. These treatments are expensive and time consuming and normally must be done at least monthly and in some cases, even weekly.

DE 196 10 361 A1 discloses a process for a galvanic deposition of semi-bright nickel coatings on a substrate, wherein said substrate has been treated by an acidic aqueous galvanic bath comprising a cyclic N-allyl- or N-vinyl-ammonium compound, in particular based on pyridinium, as brightener additive.

EP 2,852,698 B1 discloses a galvanic nickel or nickel alloy electroplating bath for depositing a semi-bright nickel or nickel alloy coating on an electrically conductive work piece; and a method therefore.

U.S. Pat. No. 5,164,069 A discloses an aqueous acid electroplating solution comprising nickel ions and one or more acetylenic compounds, specifically mono- and polyglycerol ethers of acetylenic alcohols, and processes for electrolytically depositing a bright nickel deposit onto a surface.

EP 2 801 640 A1 discloses a galvanic nickel or nickel alloy electroplating bath for depositing a semi-bright nickel or nickel alloy coating on an electrically conductive work piece.

CN 108950617A discloses a nickel nickel-alloy plating solution containing bismuth and an electroplating process thereof.

However, only very few of the known prior art suggest a way to achieve the desired complex combination of good deposit properties of a semi-bright nickel or semi-bright nickel alloy coating having good glance properties without generating high internal stress values. Prior art baths have mostly been successful to achieve semi-bright nickel or semi-bright nickel alloy coatings exhibiting some good properties while other properties mostly have kept bad or turned bad, such as combinations of good glance and high internal stress; or of bad glance and low internal stress.

Objective of the Present Invention

In view of the prior art, it was thus an object of the present invention to provide an amended galvanic nickel or nickel alloy electroplating bath for depositing a semi-bright nickel or semi-bright nickel alloy coating on a work piece, which shall not exhibit the aforementioned shortcomings of the known prior art nickel electroplating baths.

In particular, it was an object of the present invention to provide an amended galvanic nickel or nickel alloy electroplating bath which shall be able for depositing a semi-bright nickel or semi-bright nickel alloy coating on a plurality of different kind of work pieces.

What is needed therefore is a way to deposit semi-bright nickel or semi-bright nickel alloy coatings which possess good glance properties and a good leveling.

It is another object of the present invention to provide a coumarin-free galvanic nickel or nickel alloy electroplating bath that approaches or even equals the leveling characteristics of a coumarin bath.

Furthermore, it was an object of the present invention to provide semi-bright nickel or semi-bright nickel alloy coatings which possess low internal stress, in particular in combination with good glance properties.

Additionally, it was especially an object of the present invention to provide semi-bright nickel or semi-bright nickel alloy coatings which possess solely a minimum of cracks and pores in order to avoid undesired corrosion of metal surfaces if the work piece to be coated comprises metal, e.g. steel.

It is still another object of the present invention to provide a galvanic nickel or nickel alloy electroplating bath that provides good stability over the life of the bath.

Further, it was an object of the present invention to provide an amended galvanic nickel or nickel alloy electroplating bath which shall be also suitable to be used for depositing semi-bright nickel or semi-bright nickel alloy coatings.

Further, it was an object of the present invention to provide an amended galvanic nickel or nickel alloy electroplating bath comprising a simple as possible general bath composition, preferably with chemicals as cheap as possible.

SUMMARY OF THE INVENTION

These objects and also further objects which are not stated explicitly but are immediately derivable or discernible from the connections discussed herein by way of introduction are achieved by a galvanic nickel or nickel alloy electroplating bath having all features of claim 1 according to a first aspect of the present invention. Appropriate modifications of the inventive galvanic nickel or nickel alloy electroplating bath are covered in dependent claims 2 to 7. Further, claim 8 comprises a method for depositing a semi-bright nickel or semi-bright nickel alloy coating on an electrically conductive work piece according to a second aspect of the present invention. According to a third aspect of the present invention, claim 9 comprises the use of a galvanic nickel or nickel alloy electroplating bath according to the first aspect for depositing a semi-bright nickel or semi-bright nickel alloy coating by conducting a method according to the second aspect.

The invention is in particular suitable for depositing decorative coatings on an electrically conductive work piece for example in the field of decorative coatings for sanitary or automotive equipment, where there is a need for intermediate nickel or nickel alloy layers for subsequent deposition of different metal layers e.g. for corrosion protection and/or decorative layers. Typical work pieces are substrates of automotive industry having a surface to be plated with metal coatings for example automotive interior parts, front grills or emblems or work pieces of white goods industry having a surface to be plated with metal coatings for example parts of kitchen or bath room equipment such as doors, handles knobs of refrigerators, micro waves, or shower heads etc. The basic material of the substrate can be known plastics as of polycarbonate (PC), polyimide (PI), polyethylene (PE), acrylonitrile butadiene styrene (ABS) or also mixtures thereof which are made conductive by known methods providing finally a conductive surface (e.g. of copper or nickel or combinations thereof), or can be a metallic substrate (which has additionally further conductive surfaces, e.g. of copper or nickel or combinations thereof).

The present invention according to the first aspect of the present invention provides a galvanic nickel or nickel alloy electroplating bath for depositing a semi-bright nickel or semi-bright nickel alloy coating, wherein the electroplating bath comprises at least one compound having the general formula (I) and/or a salt thereof (I)

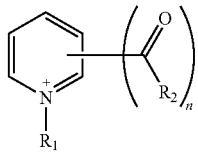

wherein $R_1$=$C_1$-$C_{18}$ hydrocarbon moiety comprising a $SO_3^-$ group, or $C_1$-$C_{18}$ hydrocarbon moiety comprising a carboxylic group, or $C_1$-$C_{18}$ hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_3$-$C_8$ hydrocarbon moiety, or $C_3$-$C_8$ hydrocarbon moiety wherein at least one carbon atom is substituted by a heteroatom;

n=1-3; and characterized in that the electroplating bath further comprises at least one acetylenic compound at a total concentration ranging from 0.002 g/l to 0.15 g/l and/or a salt thereof, wherein the at least one acetylenic compound and/or a salt thereof is selected from the group consisting of H—C≡C—$CH_2$—N(ethyl)$_2$, H—C≡C—$CH_2$—O—$CH_2$—$CH_2$—OH, $CH_3$—CH(OH)—C≡C—CH(OH)—$CH_3$, $CH_3$—C($CH_3$)(OH)—C≡C—C($CH_3$)(OH)—$CH_3$, HO—$CH_2$—C≡C—$CH_2$—OH, HO—$CH_2$—$CH_2$—O—$CH_2$—C≡C—$CH_2$—O—$CH_2$—$CH_2$—OH, H—C≡C—$CH_2$—O—$CH_2$—

$CH_2$—$CH_2$—OH, and HO—$CH_2$—C≡C—$CH_2$—O—$CH_2$—$CH_2$—$CH_2$—OH, and wherein the electroplating bath comprises chloral hydrate, wherein the chloral hydrate has a concentration of less than 0.07 g/1.

It is thus possible in an unforeseeable manner to provide an amended galvanic nickel or nickel alloy electroplating bath for depositing a semi-bright nickel or semi-bright nickel alloy coating on a work piece, which does not exhibit the aforementioned shortcomings of the known prior art nickel electroplating baths.

In particular, the amended galvanic nickel or nickel alloy electroplating bath according to the present invention is suitable for depositing a semi-bright nickel or semi-bright nickel alloy coating while employing reduced concentrations of chloral hydrate in the electroplating bath.

In particular, the amended galvanic nickel or nickel alloy electroplating bath according to the present invention is suitable for depositing a semi-bright nickel or semi-bright nickel alloy coating on a plurality of different kind of work pieces.

The present invention provides a coumarin-free galvanic nickel or nickel alloy electroplating bath that at least approaches the leveling characteristics of a coumarin bath.

The achieved semi-bright nickel or semi-bright nickel alloy coatings possess good glance properties and a good leveling.

Furthermore, the resulting semi-bright nickel or semi-bright nickel alloy coatings possess low internal stress, in particular in combination with good glance properties.

Further, the present invention provides a galvanic nickel or nickel alloy electroplating bath that provides good stability over the life of the bath.

Additionally, the obtained semi-bright nickel or semi-bright nickel alloy coatings possess solely a minimum of cracks and pores in the final outer coating whereby any undesired corrosion of a metal surface can be successfully avoided if the work piece to be coated comprises metal, e.g. steel, or conductive plastics (metallized, e.g. with copper or nickel coatings or combinations thereof).

Further, the inventive amended galvanic nickel or nickel alloy electroplating bath comprises a very simple general bath composition with mostly cheap single chemicals.

Brief Description of the Tables

Objects, features, and advantages of the present invention will also become apparent upon reading the following description in conjunction with the tables, in which:

Table 1 exhibits experiments for semi-bright nickel coatings in accordance with embodiments of the present invention.

Table 2 exhibits experiments for semi-bright nickel coatings in accordance with comparative embodiments outside of the present invention.

DETAILED DESCRIPTION OF THE INVENTION

To differentiate between embodiments within the scope of the claims of the present invention and embodiments which are outside the scope of the claims of the present invention, the latter embodiments are in the following referred to as embodiments "according to the present text". In many cases, features apply likewise to both.

A first aspect according to the present text is directed to a galvanic nickel or nickel alloy electroplating bath for depositing a semi-bright nickel or semi-bright nickel alloy coating characterized in that the electroplating bath comprises at least one compound having the general formula (I) and/or a salt thereof (I)

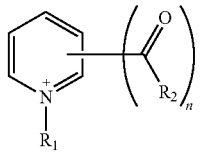

wherein $R_1$=$C_1$-$C_{18}$ hydrocarbon moiety comprising a $SO_3$ group, or $C_1$-$C_{18}$ hydrocarbon moiety comprising a carboxylic group, or $C_1$-$C_{18}$ hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_3$-$C_8$ hydrocarbon moiety, or $C_3$-$C_8$ hydrocarbon moiety wherein at least one carbon atom is substituted by a heteroatom;

n=1-3; and wherein the electroplating bath further comprises at least one acetylenic compound at a total concentration ranging from 0.001 g/l to 0.5 g/l and/or a salt thereof.

According to the present text, preferred is an electroplating bath, wherein the at least one acetylenic compound and/or a salt thereof has the general formula (V)

$$R_7—C≡C—R_8 \quad (V)$$

wherein $R_7$=hydrogen, or $C_1$-$C_8$ hydrocarbon moiety comprising at least one $OR_9$ moiety, wherein $R_9$=hydrogen, or $C_1$-$C_8$ hydrocarbon moiety comprising at least one OH moiety; wherein $R_8$=$C_1$-$C_8$ hydrocarbon moiety comprising at least one $OR_{10}$ moiety, or $C_1$-$C_8$ hydrocarbon moiety comprising at least one $NR_{11}R_{12}$ moiety, wherein $R_{10}$=hydrogen, or $C_1$-$C_8$ hydrocarbon moiety comprising at least one OH moiety; and $R_{11}$, $R_{12}$=hydrogen, or $C_1$-$C_8$ hydrocarbon moiety, wherein $R_{11}$ and $R_{12}$ are identical or different.

According to the present text, preferred is an electroplating bath, wherein the at least one acetylenic compound and/or a salt thereof has the general formula (V)

$$R_7—C≡C—R_8 \quad (V)$$

wherein $R_7$=hydrogen, or $C_1$-$C_4$, preferably $C_1$ or $C_2$ or $C_3$, alkyl moiety comprising at least one $OR_9$ moiety, wherein $R_9$=hydrogen, or $C_1$-$C_8$ hydrocarbon moiety comprising at least one OH moiety; wherein $R_8$=$C_1$-$C_4$, preferably $C_1$ or $C_2$ or $C_3$, alkyl moiety comprising at least one $OR_{10}$ moiety, or $C_1$-$C_4$, preferably $C_1$ or $C_2$, alkyl moiety comprising at least one $NR_{11}R_{12}$ moiety, wherein $R_{10}$=hydrogen, or $C_1$-$C_8$ hydrocarbon moiety comprising at least one OH moiety; and $R_{11}$, $R_{12}$=hydrogen, or $C_1$-$C_8$ hydrocarbon moiety, wherein $R_{11}$ and $R_{12}$ are identical or different.

According to the present text, preferred is an electroplating bath, wherein the at least one acetylenic compound and/or a salt thereof has the general formula (V)

$$R_7—C≡C—R_8 \quad (V)$$

wherein $R_7$=hydrogen, or $C_1$-$C_4$, preferably $C_1$ or $C_2$ or $C_3$, alkyl moiety comprising at least one $OR_9$ moiety, wherein $R_9$=hydrogen, or $C_1$-$C_3$, preferably $C_1$ or $C_2$, alkyl moiety comprising at least one OH moiety;

wherein $R_8$=$C_1$-$C_4$, preferably $C_1$ or $C_2$ or $C_3$, alkyl moiety comprising at least one $OR_{10}$ moiety, or $C_1$-$C_4$, preferably $C_1$ or $C_2$, alkyl moiety comprising at least one $NR_{11}R_{12}$ moiety, wherein $R_{10}$=hydrogen, or $C_1$-$C_3$, preferably $C_1$ or $C_2$, alkyl moiety comprising at least one OH moiety; and $R_{11}$, $R_{12}$=hydrogen, or $C_1$-$C_4$, preferably $C_1$ or $C_2$, alkyl moiety, wherein $R_{11}$ and $R_{12}$ are identical or different.

According to the present text, preferred is an electroplating bath, wherein the at least one acetylenic compound and/or a salt thereof has the general formula (V)

$$R_7—C≡C—R_8 \quad (V)$$

wherein $R_7$=hydrogen, or $CH_2$—OH, or CH(OH)—$CH_3$, $C(CH_3)$(OH)—$CH_3$, or $CH_2$—O—$CH_2$—$CH_2$—OH, or $CH_2$—O—$CH_2$—$CH_2$—$CH_2$—OH; and wherein $R_8$=$CH_2$—OH, or CH(OH)—$CH_3$, $C(CH_3)$(OH)—$CH_3$, or $CH_2$—O—$CH_2$—$CH_2$—OH, or $CH_2$—O—$CH_2$—$CH_2$—$CH_2$—OH, or $CH_2$—N(ethyl)$_2$.

According to the present text, preferred is an electroplating bath, wherein the at least one acetylenic compound and/or a salt thereof is selected from the group consisting of H—C≡C—$CH_2$—N(ethyl)$_2$, H—C≡C—$CH_2$—O—$CH_2$—$CH_2$—OH, $CH_3$—CH(OH)—C≡C—CH(OH)—$CH_3$, $CH_3$—$C(CH_3)$(OH)—C≡C—$C(CH_3)$(OH)—$CH_3$, HO—$CH_2$—C≡C—$CH_2$—OH, HO—$CH_2$—$CH_2$—O—$CH_2$—C≡C—$CH_2$—O—$CH_2$—$CH_2$—OH, H—C≡C—$CH_2$—O—$CH_2$—$CH_2$—$CH_2$—OH, H—C≡C—$CH_2$—OH, and HO—$CH_2$—C≡C—$CH_2$—O—$CH_2$—$CH_2$—$CH_2$—OH.

According to the present text, preferred is an electroplating bath, wherein the electroplating bath comprises the at least one acetylenic compound and/or a salt thereof at a total concentration ranging from 0.001 g/l to 0.4 g/l, preferably from 0.001 g/l to 0.25 g/l, more preferably from 0.002 g/l to 0.15 g/l, even more preferably from 0.003 g/l to 0.1 g/l, even more preferably from 0.004 g/l to 0.08 g/l, and most preferably from 0.001 g/l to 0.08 g/l.

According to the present text, preferred is an electroplating bath, wherein the electroplating bath comprises chloral hydrate, preferably at a concentration ranging from 0.005 g/l to 0.5 g/l, more preferably from 0.01 g/l to 0.1 g/l, and most preferably from 0.04 g/l to 0.085 g/l.

According to the present text, preferred is an electroplating bath, wherein the electroplating bath comprises chloral hydrate at a concentration less than 0.07 g/l, preferably less than 0.045 g/l.

According to the present text, preferred is an electroplating bath, wherein the electroplating bath comprises additionally at least one bright nickel additive and/or a salt thereof, preferably PPS, PES and/or PPS-OH, preferably at a total concentration ranging from 0.005 g/l to 10 g/1, more preferably from 0.005 g/l to 1 g/1, and most preferably from 0.01 g/l to 0.1 g/1.

According to the present text, preferred is an electroplating bath, wherein the electroplating bath does not comprise formaldehyde or does comprise formaldehyde at a concentration less than 0.1 g/1, preferably less than 0.05 g/1, more preferably less than 0.025 g/1, even more preferably less than 0.01 g/1, and most preferably less than 0.005 g/1.

According to the present text, preferred is an electroplating bath, wherein the electroplating bath does not comprise an aromatic sulfonic acid and/or a salt thereof, preferably does not comprise 1,3,6-naphtalene trisulfonic acid and/or a salt thereof, and/or that the electroplating bath does not comprise benzoic acid sulfimide (saccharine).

According to the present text, preferred is an electroplating bath, wherein the electroplating bath further comprises at least one compound selected from internal stress reducers and/or salts thereof, wherein the at least one internal stress reducer is selected as salicylic acid and/or a salt thereof, preferably at a total concentration ranging from 0.1 g/l to 10 g/1, more preferably from 0.3 g/l to 6 g/1, and most preferably from 0.5 g/l to 3.5 g/1.

A second aspect according to the present text is directed to a method for depositing a semi-bright nickel or semi-bright nickel alloy coating on an electrically conductive work piece comprising the following method steps:

i) Bringing the work piece into contact with a galvanic nickel or nickel alloy electroplating bath according to the first aspect according to the present text;

ii) Bringing at least one anode into contact with the galvanic nickel or nickel alloy electroplating bath according to the first aspect according to the present text;

iii) Applying a voltage across the work piece and the at least one anode; and iv) Electrodepositing a semi-bright nickel or semi-bright nickel alloy coating on the work piece.

A third aspect according to the present text is directed to the use of a galvanic nickel or nickel alloy electroplating bath according to the first aspect according to the present text for depositing a semi-bright nickel or semi-bright nickel alloy coating by conducting a method according to the second aspect according to the present text.

In the following, primarily the present invention is described in further detail.

The present invention according to the first aspect provides a galvanic nickel or nickel alloy electroplating bath for depositing a semi-bright nickel or semi-bright nickel alloy coating, wherein the electroplating bath comprises at least one compound having the general formula (I) and/or a salt thereof, wherein $R_1$=$C_1$-$C_{18}$ hydrocarbon moiety comprising a $SO_3$ group, or $C_1$-$C_{18}$ hydrocarbon moiety comprising a carboxylic group, or $C_1$-$C_{18}$ hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_3$-$C_8$ hydrocarbon moiety, or $C_3$-$C_8$ hydrocarbon moiety wherein at least one carbon atom is substituted by a heteroatom;

n=1-3; and characterized in that the electroplating bath further comprises at least one acetylenic compound at a total concentration ranging from 0.002 g/l to 0.15 g/l and/or a salt thereof, wherein the at least one acetylenic compound and/or a salt thereof is selected from the group consisting of H—C≡C—$CH_2$—N(ethyl)$_2$, H—C≡C—$CH_2$—O—$CH_2$—$CH_2$—OH, $CH_3$—CH(OH)—C≡C—CH(OH)—$CH_3$, $CH_3$—$C(CH_3)$(OH)—C≡C—$C(CH_3)$(OH)—$CH_3$, HO—$CH_2$—C≡C—$CH_2$—OH, HO—$CH_2$—$CH_2$—O—$CH_2$—C≡C—$CH_2$—O—$CH_2$—$CH_2$—OH, H—C≡C—$CH_2$—O—$CH_2$—$CH_2$—$CH_2$—OH, and HO—$CH_2$—C≡C—$CH_2$—O—$CH_2$—$CH_2$—$CH_2$—OH, and wherein the electroplating bath comprises chloral hydrate, wherein the chloral hydrate has a concentration of less than 0.07 g/l.

The addition of the at least one acetylenic compound at a total concentration ranging from 0.002 g/l to 0.15 g/l and/or a salt thereof provides an electroplating bath which enables depositing a semi-bright nickel or semi-bright nickel alloy coating with advanced properties, such as good or even excellent glance properties and a good or even excellent levelling.

The galvanic nickel or nickel alloy electroplating bath for depositing a semi-bright nickel or semi-bright nickel alloy coating according to the present invention comprises nickel ions. This applies likewise to the electroplating bath according to the present text.

According to the present invention/present text, respectively, salts include, but are not limited to, alkaline metal salts such as sodium salt, potassium salt and the like; alkaline earth metals such as calcium salt, magnesium salt and the like; organic amine salts such as triethylamine salt, pyridine salt, picoline salt, ethanolamine salt, triethanolamine salt, dicyclohexylamine salt, and the like; inorganic acid salts such as halides, preferably chloride, bromide, fluoride and/or iodide, hydrochloride, hydrobromide, sulfate, phosphate and the like; organic acid salts such as formate, acetate, trifluoroacetate, maleate, tartrate and the like; sulfonates such as methanesulfonate, benzenesulfonate, p-toluenesulfonate, and the like; amino acid salts such as arginate, asparginate, glutamate and the like.

Preferably, salts include alkaline metal salts, such as sodium salt, potassium salt and the like; alkaline earth metals such as calcium salt, magnesium salt and the like; and/or inorganic acid salts such as halides, more preferably chloride, bromide, fluoride and/or iodide, sulfate, and the like.

According to the present text, preferred is an electroplating bath, wherein the at least one acetylenic compound and/or a salt thereof is an aliphatic acetylenic compound and/or a salt thereof. Generally, in contrast to an aromatic acetylenic compound, providing at least one aliphatic acetylenic compound in the electroplating bath results in improved properties of the deposited semi-bright nickel or semi-bright nickel alloy coating.

According to the present text, preferred is an electroplating bath, wherein the at least one acetylenic compound and/or a salt thereof comprises at least one OH moiety or at least one $N(ethyl)_2$ moiety. Generally, the hydroxy moiety or diethyl amine moiety provides an acetylenic compound with polar properties, thereby improving the deposition process.

According to the present text, preferred is an electroplating bath, when selecting $R^7$ as hydrogen, $R^8$ cannot be selected as $CH_2$—OH.

Selecting the acetylenic compound as a substituted alkyne group according to formula (V) results in an improved glance and levelling of the deposited semi-bright nickel or semi-bright nickel alloy coating. An alkyl moiety utilized in the context of the present invention may comprise an n-alkyl moiety, an iso-alkyl moiety or a tert-alkyl moiety.

According to the present text, preferred is an electroplating bath, wherein the compounds according to formula (V) are selected as H—C≡C—$CH_2$—$N(ethyl)_2$ (Golpanol DEP), H—C≡C—$CH_2$—O—$CH_2$—$CH_2$—OH (Golpanol PME), HO—$CH_2$—C≡C—$CH_2$—OH (Golpanol BOZ), $CH_3$—CH(OH)—C≡C—CH(OH)—$CH_3$ (Golpanol HD), $CH_3$—C($CH_3$)(OH)—C≡CC($CH_3$)(OH)—$CH_3$, HO—$CH_2$—$CH_2$—O—$CH_2$—C≡C—$CH_2$—O—$CH_2$—$CH_2$—OH (Golpanol BEO), H—C≡C—$CH_2$—O—$CH_2$—$CH_2$—$CH_2$—OH (Golpanol PAP), HO—$CH_2$—C≡C—$CH_2$—O—$CH_2$—$CH_2$—$CH_2$—OH (Golpanol BMP), H—C≡C—$CH_2$—OH (Golpanol PA) and/or a salt thereof, preferably as Golpanol DEP, Golpanol PME, Golpanol BOZ, Golpanol HD, and/or a salt thereof.

However, according to the present invention, preferred is an electroplating bath, wherein the at least one acetylenic compound is selected as H—C≡C—$CH_2$—$N(ethyl)_2$ (Golpanol DEP), H—C≡C—$CH_2$—O—$CH_2$—$CH_2$—OH (Golpanol PME), HO—$CH_2$—C≡C—$CH_2$—OH (Golpanol BOZ), $CH_3$—CH(OH)—C≡C—CH(OH)—$CH_3$ (Golpanol HD), $CH_3$—C($CH_3$)(OH)—C≡C—C($CH_3$)(OH)—$CH_3$, HO—$CH_2$—$CH_2$—O—$CH_2$—C≡C—$CH_2$—O—$CH_2$—$CH_2$—OH (Golpanol BEO), H—C≡C—$CH_2$—O—$CH_2$—$CH_2$—$CH_2$—OH (Golpanol PAP), HO—$CH_2$—C≡C—$CH_2$—O—$CH_2$—$CH_2$—$CH_2$—OH (Golpanol BMP) and/or a salt thereof, preferably as Golpanol DEP, Golpanol PME, Golpanol BOZ, Golpanol HD, and/or a salt thereof.

Preferably, when the electroplating bath comprises $CH_3$—CH(OH)—C≡C—CH(OH)$CH_3$ (Golpanol HD), the electroplating bath cannot comprise chloralhydrate at a concentration higher than 0.15 g/l, preferably cannot comprise chloralhydrate at a concentration higher than 0.20 g/l, and more preferably cannot comprise chloralhydrate at a concentration higher than 0.25 g/l.

Preferably, when the electroplating bath comprises $CH_3$—CH(OH)—C≡C—CH(OH)$CH_3$ (Golpanol HD), the electroplating bath cannot comprise salicylic acid at a concentration higher than 1.5 g/l, preferably cannot comprise salicylic acid at a concentration higher than 2.0 g/l, and more preferably cannot comprise salicylic acid at a concentration from 2.4 g/l to 2.6 g/l.

Preferably, when the electroplating bath comprises $CH_3$—CH(OH)—C≡C—CH(OH)$CH_3$ (Golpanol HD), the electroplating bath cannot comprise HO—$CH_2$—C≡C—$CH_2$—O—$CH_2$—$CH_2$—$CH_2$—OH (Golpanol BMP) at a concentration less than 0.050 g/l, preferably cannot comprise HO—$CH_2$—C≡C—$CH_2$—O—$CH_2$—$CH_2$—$CH_2$—OH (Golpanol BMP) at a concentration less than 0.030 g/l, and more preferably cannot comprise HO—$CH_2$—C≡C—$CH_2$—O—$CH_2$—$CH_2$—$CH_2$—OH (Golpanol BMP) at a concentration from 0.010 g/l to 0.020 g/l.

Preferably, when the electroplating bath comprise $CH_3$—CH(OH)—C≡C—CH(OH)$CH_3$ (Golpanol HD), the electroplating bath cannot comprise HO—$CH_2$—C≡C—$CH_2$—OH (Golpanol BOZ) at a concentration less than 0.060 g/l, preferably cannot comprise HO—$CH_2$—C≡C—$CH_2$—OH (Golpanol BOZ) at a concentration less than 0.050 g/l, and more preferably cannot comprise HO—$CH_2$—C≡C—$CH_2$—OH (Golpanol BOZ) at a concentration from 0.030 g/l to 0.040 g/l.

Preferably, when the electroplating bath comprises HO—$CH_2$—$CH_2$—O—$CH_2$—C≡C—$CH_2$—O—$CH_2$—$CH_2$—OH (Golpanol BEO) and/or H—C≡C—$CH_2$—O—$CH_2$—$CH_2$—OH (Golpanol PME), the electroplating bath cannot comprise 1-benzylpyridinium-3-carboxylate at a concentration from 0.05 ml/l to 0.5 ml/l.

Preferably, the electroplating bath of the present invention comprises the at least one acetylenic compound and/or a salt thereof at a total concentration ranging from 0.003 g/l to 0.1 g/l, even more preferably from 0.004 g/l to 0.08 g/l, and most preferably from 0.001 g/l to 0.08 g/l.

Preferably, the electroplating bath of the present invention comprises the at least one acetylenic compound and/or a salt thereof at a total concentration ranging from 0.005 g/l to 0.15 g/l, more preferably from 0.010 g/l to 0.15 g/l, even more preferably from 0.015 g/l to 0.15 g/l, even more preferably from 0.020 g/l to 0.15 g/l, even more preferably from 0.030 g/l to 0.15 g/l, even more preferably from 0.040 g/l to 0.15 g/l, even more preferably from 0.050 g/l to 0.15 g/l, even more preferably from 0.060 g/l to 0.15 g/l, even more preferably from 0.070 g/l to 0.15 g/l, even more preferably from 0.080 g/l to 0.15 g/l, even more preferably from 0.090 g/l to 0.15 g/l, even more preferably from 0.10 g/l to 0.15 g/l, even more preferably from 0.11 g/l to 0.15 g/l, even more preferably from 0.12 g/l to 0.15 g/l, even more preferably from 0.13 g/l to 0.15 g/l, and even more preferably from 0.14 g/l to 0.15 g/l.

Preferably, the electroplating bath of the present invention comprises the at least one acetylenic compound and/or a salt thereof at a total concentration ranging from 0.005 g/l to 0.15 g/l, even more preferably from 0.005 g/l to 0.14 g/l, even more preferably from 0.005 g/l to 0.13 g/1, even more preferably from 0.005 g/l to 0.12 g/1, even more preferably from 0.005 g/l to 0.11 g/1, even more preferably from 0.005 g/l to 0.10 g/1, even more preferably from 0.005 g/l to 0.090 g/1, even more preferably from 0.005 g/l to 0.080 g/1, even more preferably from 0.005 g/l to 0.070 g/1, even more preferably from 0.005 g/l to 0.060 g/1, even more preferably from 0.005 g/l to 0.050 g/1, even more preferably from 0.005 g/l to 0.040 g/1, even more preferably from 0.005 g/l to 0.030 g/1, even more preferably from 0.005 g/l to 0.020 g/1, even more preferably from 0.005 g/l to 0.010 g/1.

Selecting the total concentration of the at least one acetylenic compound in the preferred concentration ranges allows for improved properties of the deposited semi-bright nickel or semi-bright nickel alloy coating.

Preferably, the electroplating bath comprises at least two of the acetylenic compounds and/or salts thereof, preferably at least three of the acetylenic compounds and/or salts thereof.

As used herein, the term "galvanic nickel or nickel alloy electroplating bath", when applied for depositing a semi-bright nickel or semi-bright nickel alloy coating, refers to a galvanic nickel bath, which is based on the so-called "Watts electrolytic bath", which has the general following composition:

| | |
|---|---|
| 240-550 g/l | nickel sulfate ($NiSO_4 \cdot 7\ H_2O$ or $NiSO_4 \cdot 6\ H_2O$), |
| 30-150 g/l | nickel chloride ($NiCl_2 \cdot 6\ H_2O$), and |
| 30-55 g/l | boric acid ($H_3BO_3$). |

The large amount of nickel sulfate provides the necessary concentration of nickel ions, while nickel chloride improves anode corrosion and increases conductivity. Boric acid is used as a weak buffer to maintain the pH value.

Preferably, the galvanic nickel and nickel alloy electroplating baths has a chloride content ranging from 10 g/l to 50 g/l, preferably ranging from 15 g/l to 40 g/l, and more preferably ranging from 20 g/l to 30 g/l.

Nickel chloride may be replaced partly or entirely by sodium chloride.

Further, chloride in the electrolyte may be replaced partly or entirely by equivalent amounts of bromide.

Generally, chloral hydrate helps to set up the potential and serves further to amend the glance properties and the throwing power of the deposited coatings.

Preferably, the electroplating bath of the present invention comprises chloral hydrate at a concentration ranging from 0.001 g/l to 0.069 g/l, more preferably at a concentration ranging from 0.005 g/l to 0.069 g/l, even more preferably at a concentration ranging from 0.010 g/l to 0.069 g/l, even more preferably at a concentration ranging from 0.020 g/l to 0.069 g/l, even more preferably at a concentration ranging from 0.025 g/l to 0.069 g/l, even more preferably at a concentration ranging from 0.030 g/l to 0.069 g/l, even more preferably at a concentration ranging from 0.035 g/l to 0.069 g/l, even more preferably at a concentration ranging from 0.040 g/l to 0.069 g/l, even more preferably at a concentration ranging from 0.045 g/l to 0.069 g/l, even more preferably at a concentration ranging from 0.050 g/l to 0.069 g/l, even more preferably at a concentration ranging from 0.055 g/l to 0.069 g/l, even more preferably at a concentration ranging from 0.060 g/l to 0.069 g/l, even more preferably at a concentration ranging from 0.065 g/l to 0.069 g/l.

Preferably, the electroplating bath of the present invention comprises chloral hydrate at a concentration ranging from 0.001 g/l to 0.069 g/l, more preferably at a concentration ranging from 0.001 g/l to 0.065 g/l, even more preferably at a concentration ranging from 0.001 g/l to 0.060 g/l, even more preferably at a concentration ranging from 0.001 g/l to 0.055 g/l, even more preferably at a concentration ranging from 0.001 g/l to 0.050 g/l, even more preferably at a concentration ranging from 0.001 g/l to 0.045 g/l, even more preferably at a concentration ranging from 0.001 g/l to 0.040 g/l, even more preferably at a concentration ranging from 0.001 g/l to 0.035 g/l, even more preferably at a concentration ranging from 0.001 g/l to 0.030 g/l, even more preferably at a concentration ranging from 0.001 g/l to 0.025 g/l, even more preferably at a concentration ranging from 0.001 g/l to 0.020 g/l, even more preferably at a concentration ranging from 0.001 g/l to 0.015 g/l, even more preferably at a concentration ranging from 0.001 g/l to 0.010 g/l, even more preferably at a concentration ranging from 0.001 g/l to 0.005 g/l.

Selecting the concentration of chloral hydrate in the preferred concentration ranges allows for optimal properties of the deposited semi-bright nickel or semi-bright nickel alloy coating, while reducing the overall chloral hydrate consumption, thereby reducing costs.

Preferably, the electroplating bath of the present invention comprises chloral hydrate at a concentration less than 0.045 g/l.

Preferably, the electroplating bath of the present invention comprises chloral hydrate at a concentration less than 0.065 g/l, more preferably less than 0.060 g/l, even more preferably less than 0.055 g/l, even more preferably less than 0.050 g/l, even more preferably less than 0.045 g/l, even more preferably less than 0.040 g/l, even more preferably less than 0.040 g/l. In some cases even more preferably less than 0.035 g/l, even more preferably less than 0.030 g/l, even more preferably less than 0.025 g/l, even more preferably less than 0.020 g/l, even more preferably less than 0.015 g/l, even more preferably less than 0.010 g/l.

Preferably, the electroplating bath may comprise at least one compound selected from internal stress reducers, such as benzoic acid, acetic acid and/or salicylic acid, and/or salts thereof and wetting agents, such as succinate, sulfosuccinic acid, 2-ethylhexylsulfate, dihexyl sulfosuccinate, and/or diamyl sulfosuccinate, and/or salts thereof, preferably at a total concentration ranging from 0.001 g/l to 8 g/1, more preferably from 0.01 g/l to 2 g/1, and most preferably from 0.02 g/l to 1 g/1.

Preferably, the electroplating bath may comprise at least one wetting agent, such as succinate, sulfosuccinic acid, 2-ethylhexylsulfate, dihexyl sulfosuccinate, and/or diamyl sulfosuccinate, and/or a salt, preferably a sodium salt, thereof, preferably at a total concentration ranging from 0.005 g/l to 0.5 g/1, more preferably from 0.01 g/l to 0.35 g/1, and most preferably from 0.02 g/l to 0.1 g/1.

Preferably, the electroplating bath may comprise at least one compound selected from internal stress reducers and/or salts thereof, wherein the at least one internal stress reducer is selected as salicylic acid and/or a salt thereof, preferably at a total concentration ranging from 0.1 g/l to 10 g/l, more preferably from 0.3 g/l to 6 g/l, and most preferably from 0.5 g/l to 3.5 g/l. Such an additive affects positively the hardness, durability and the optical properties of the achieved coatings.

Preferably, the electroplating bath further comprises an alkali metal benzoate, preferably sodium benzoate, preferably at a concentration ranging from 0.005 g/l to 5 g/l, more preferably from 0.02 g/l to 2 g/l, and most preferably from 0.05 g/l to 0.5 g/l. Such additive compounds help to reduce internal stress of the deposited coatings.

Preferably, the electroplating bath of the present invention comprises additionally at least one bright nickel additive and/or a salt thereof, preferably PPS (3-(pyridinium-1-yl)-propane-1-sulfonate), PES (3-(pyridinium-1-yl)-ethane-1-sulfonate), and/or PPS-OH (3-(pyridinium-1-yl)-(2-hydroxy-propane-1-sulfonate)), preferably at a total concentration ranging from 0.005 g/l to 10 g/l, more preferably from 0.005 g/l to 1 g/l, and most preferably from 0.01 g/l to 0.1 g/l. Preferably, the concentration ratio between the at least one additional bright nickel additive and/or a salt thereof, such as PPS, PES, and/or PPS-OH, and the at least one compound having the general formula (I) and/or salt thereof is less than 10:1, more preferably less than 5:1, and most preferably less than 3:1. This applies likewise to the electroplating bath according to the present text.

This offers a tremendous advantage by being able to substitute large quantities of expensive compounds having formula (I) by cheap known bright nickel additives, such as PPS, PES, and/or PPS-OH, without that the known disadvantages of PPS, PES, and PPS-OH occur.

Preferably, the electroplating bath of the present invention does not comprise formaldehyde or does comprise formaldehyde at a concentration less than 0.1 g/l, preferably less than 0.05 g/l, more preferably less than 0.025 g/l, even more preferably less than 0.01 g/l, and most preferably less than 0.005 g/l.

The presence of formaldehyde in the galvanic nickel or nickel alloy electroplating bath affects the brightness of the nickel or nickel alloy coating deposited on the work piece. By preferably omitting formaldehyde or preferably reducing the concentration of formaldehyde, it can be advantageously ensured that a semi-bright nickel or semi-bright nickel alloy coating is deposited. In particular, this is in contrast to the prior art, wherein high concentrations of formaldehyde in the electroplating bath result in depositing bright nickel or bright nickel alloy coatings, not semi-bright nickel or semi-bright nickel alloy coatings.

Preferably, the electroplating bath of the present invention does not comprise an aromatic sulfonic acid and/or a salt thereof, preferably does not comprise 1,3,6-naphtalene trisulfonic acid and/or a salt thereof, and/or the electroplating bath does not comprise benzoic acid sulfimide (saccharine).

The presence of an aromatic sulfonic acid or benzoic acid sulfimide, which is also known as saccharine, in the galvanic nickel or nickel alloy electroplating bath affects the brightness, crystal structure and potential of the nickel or nickel alloy coating deposited on the work piece. By preferably omitting an aromatic sulfonic acid or benzoic acid sulfimide in the electroplating bath, it can be advantageously ensured that a semi-bright nickel or semi-bright nickel alloy coating is deposited.

Preferably, a cathodic current density amounts to values ranging from 1 to 10 A/dm$^2$, preferably ranging from 2 to 7 A/dm$^2$, and more preferably ranging from 3 to 5 A/dm$^2$.

Preferably, a working temperature ranges from 40° C. to 70° C., more preferably from 45° C. to 65° C., and most preferably from 50° C. to 60° C.

Preferably, a pH-Value of the electroplating bath ranges from 2 to 6, more preferably from 3 to 5, and most preferably from 3.5 to 4.5.

The galvanic nickel or nickel alloy electroplating bath can be deposited on a plurality of different kind of work pieces based on a metal and/or metal alloy, in particular steel, copper, brass and/or zinc diecasting; or on "POP" work pieces. "POP" work pieces denotes "plating on plastics" work pieces. Thus, POP comprise a synthetic work pieces, preferably based on at least one polymeric compound, more preferably based on acrylonitrile-butadiene-styrene (ABS), polyamide, polypropylene or ABS/PC (polycarbonate).

The expression n=1-3, 1 or 2, or 1 in general formula (I) defines the number of substituents on the ring system of general formula (I). Thus, if n=3, the ring system of general formula (I) comprises three substituents, which can be arranged in ortho, meta and/or para position in relation to the nitrogen atom of the ring system following hereby the general known substitution rules of organic chemistry. Conclusively, if n=2, there are two of such substituents; while if n=1, there is solely one such substituent on the ring system present.

Electrolytes for obtaining matte nickel or nickel alloy deposits, by contrast, do not form part of this invention.

Preferably, the electroplating bath comprises at least one compound having the general formula (I), wherein $R_1$=$C_1$-$C_8$, preferably $C_1$-$C_4$, hydrocarbon moiety comprising a $SO_3$ group, or $C_1$-$C_8$, preferably $C_1$-$C_4$, hydrocarbon moiety comprising a carboxylic group, or $C_1$-$C_8$, preferably $C_1$-$C_4$, hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_4$-$C_8$ hydrocarbon moiety, or $C_3$-$C_8$ hydrocarbon moiety wherein at least one carbon atom is substituted by a heteroatom; and n=1 or 2.

Preferably, the electroplating bath comprises at least one compound having the general formula (I), wherein $R_1$=$C_1$-$C_8$, preferably $C_1$-$C_4$, hydrocarbon moiety comprising a $SO_3$ group, or $C_1$-$C_8$, preferably $C_1$-$C_4$, hydrocarbon moiety comprising a carboxylic group, or $C_1$-$C_8$, preferably $C_1$-$C_4$, hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_8$, preferably $C_1$-$C_4$, aliphatic hydrocarbon moiety, or $C_1$-$C_8$, preferably $C_1$-$C_4$, hydrocarbon moiety comprising an aromatic and/or a heteroaromatic group, wherein $R_3$, $R_4$ and $R_5$ are identical or different;

$R_6$=$C_4$ or $C_5$ hydrocarbon moiety, or $C_4$-$C_5$ hydrocarbon moiety wherein at least one carbon atom is substituted by a sulfur or oxygen atom; and n=1.

Preferably, the electroplating bath comprises at least one compound having the general formula (I), wherein $R_1$=n-ethyl-$SO_3^-$, or n-propyl-$SO_3^-$, or n-butyl-$SO_3$, or benzyl, or $CH_2$—COOH and/or a salt thereof, preferably the sodium salt $CH_2$—COONa, moiety;

$R_2$=$NH_2$, or N(ethyl)$_2$, or O(ethyl), or OH moiety, or cyclic $NR_6$ moiety, wherein $R_6$=$C_4$ or $C_5$ hydrocarbon moiety, or $C_4$-$C_5$ hydrocarbon moiety wherein at least one carbon atom is substituted by a sulfur or an oxygen atom; and n=1.

Preferably, the electroplating bath comprises at least one compound having the general formula (I) and/or a salt thereof, wherein $R_1$ is not hydrogen.

Preferably, the electroplating bath comprises at least one compound having the general formula (I) and/or a salt thereof, wherein at least one moiety C(O)$R_2$ is in ortho, meta and/or para position at the aromatic ring.

Preferably, the electroplating bath comprises the at least one compound having the general formula (I) and/or a salt thereof at a total concentration ranging from 0.005 g/l to 10 g/l, more preferably from 0.008 g/l to 5 g/l, even more preferably from 0.01 g/l to 1 g/l, and most preferably from 0.01 g/l to 0.1 g/l.

All preferred features of the electroplating bath according to the first aspect of the present invention are preferably also comprised by the method according to the second aspect of the present invention and the use according to the third aspect of the present invention. In other words, the aforementioned regarding the first aspect of the present invention/the first aspect according to the present text (i.e. electroplating bath, most preferably including its preferred variants), preferably applies likewise to the method of the present invention (second aspect of the present invention) and the second aspect according to the present text, respectively.

The present invention according to the second aspect provides a method for depositing a semi-bright nickel or semi-bright nickel alloy coating on an electrically conductive work piece, comprising the following method steps:

i) Bringing the work piece into contact with a galvanic nickel or nickel alloy electroplating bath according to the first aspect of the present invention;
ii) Bringing at least one anode into contact with the galvanic nickel or nickel alloy electroplating bath;
iii) Applying a voltage across the work piece and the at least one anode; and
iv) Electrodepositing a semi-bright nickel or semi-bright nickel alloy coating on the work piece.

Preferred for the method, a cathodic current density amounts to values ranging from 1 to 10 A/dm$^2$, preferably ranging from 2 to 7 A/dm$^2$, and more preferably ranging from 3 to 5 A/dm$^2$.

Preferred for the method, a working temperature ranges from 40° C. to 70° C., more preferably from 45° C. to 65° C., and most preferably from 50° C. to 60° C.

Preferred for the method, a pH-Value of the electroplating bath ranges from 2 to 6, more preferably from 3 to 5, and most preferably from 3.5 to 4.5.

The present invention according to the third aspect provides a use of a galvanic nickel or nickel alloy electroplating bath according to the first aspect of the present invention for depositing a semi-bright nickel or semi-bright nickel alloy coating by conducting a method according to the second aspect of the present invention.

Preferably, features of the electroplating bath of the present invention/according to the first aspect according to the text (most preferably including its preferred variants), apply likewise to the use of the present invention/third aspect according to the present text, respectively.

Preferred for the electroplating bath, method and/or use, compounds of the general formula (I) specifically comprise the chemical compounds having the following formulas (II), (Ill) and (IV):

(II)

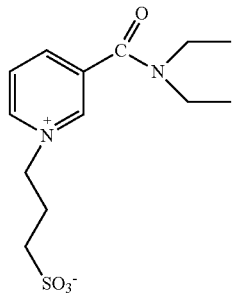

(III)

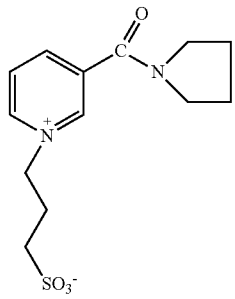

(IV)

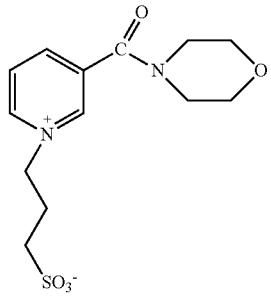

The synthesis procedures are summarized in the following:

3-(3-(Diethylcarbamoyl) pyridinium-1-yl) propane-1-sulfonate (II)

10 g (0.0555 mol) of nicotinic acid diethylamide (99%) is dissolved in 50 ml of ethanol. Subsequently 6.78 g (0.0555 mol) of 1,3-propane sultone is added. Then, the reaction mixture is cooked under reflux for 48 hours at 78° C.

After finishing of the reaction, the reaction mixture is cooled before 100 ml of diethyl ether is added at room temperature. The resulting white solid is filtered at 4° C., washed with additional 100 ml of diethyl ether, and finally vacuum dried. 9.00 g of a white solid is yielded (54% of theory).

3-(3-(pyrrolidin-1-carbonyl) pyridinium-1-yl) propane-1-sulfonate (III)

10 g (0.056747 mol) of 3-(pyrrolidin-1-carbonyl) pyridine is dissolved in 50 ml of ethanol. Subsequently 6.93 g (0.056747 mol) of 1,3-propane sultone is added. Then, the reaction mixture is cooked under reflux for 48 hours at 78° C.

After finishing of the reaction, the reaction mixture is cooled before 100 ml of diethyl ether is added at room temperature. The resulting white solid is filtered at 4° C., washed with additional 100 ml of diethyl ether, and finally vacuum dried. 8.635 g of a white solid is yielded (51% of theory).

3-(3-(morpholin-4-carbonyl) pyridinium-1-yl) propane-1-sulfonate (IV)

10 g (0.05206 mol) of 3-(morpholine-1-carbonyl) pyridine is dissolved in 50 ml of ethanol. Subsequently 6.36 g (0.05206 mol) of 1,3-propane sultone is added. Then, the reaction mixture is cooked under reflux for 48 hours at 78° C.

After finishing of the reaction, the reaction mixture is cooled before 100 ml of diethyl ether is added at room temperature. The resulting white solid is filtered at 4° C., washed with additional 100 ml of diethyl ether, and finally vacuum dried.

8.10 g of a white solid is yielded (49.5% of theory).

The present invention thus addresses the problem of providing an amended galvanic nickel or nickel alloy electroplating bath for depositing a semi-bright nickel or semi-bright nickel alloy coating on a plurality of a different kind of work pieces, as well as method and use therefore. The electroplating bath according to the present invention offers a way to achieve semi-bright nickel or semi-bright nickel alloy coatings having a good and unique combination of desired properties, such as glance, leveling, ductility and so on, whereas known prior art baths can mostly provide only some of these properties, wherein mostly at least one severe disadvantage in form of a bad underside property is present. The electroplating baths according to the present invention offer par example on steel the desired property combination of having a good leveling, a low hardness and a high ductility; and on POP's the combination of a good glance and simultaneously low internal stress values.

The following non-limiting examples are provided to illustrate an embodiment of the present invention and to facilitate understanding of the invention, but are not intended to limit the scope of the invention, which is defined by the claims appended hereto.

In general, there has to be mentioned, that all experiments, comprising the experiments in accordance with the present invention as well as the comparative embodiments outside of the present invention, have been conducted using a so-called "Watts-based electrolytic bath" having the following composition:

| | |
|---|---|
| 280 g/l | nickel sulfate ($NiSO_4 \cdot 6\ H_2O$), |
| 40 g/l | nickel chloride ($NiCl_2 \cdot 6\ H_2O$), |
| 45 g/l | boric acid ($H_3BO_3$), |
| 0.300 g/l | sodium benzoate, |
| 0.025 g/l | compound of formula (II), |
| 0.067 g/l | PPS, |
| 0.0425 g/l | chloral hydrate, and |
| 0.05 g/l | sodium dihexyl sulfosuccinate. |

The nickel deposition took place in a Hull cell wherein 2.5 Ampere was applied for 10 minutes at a temperature of 55° C.+/−3° C. and at a pH of 4.2. Further, 3 liter/min pressure air was introduced during nickel deposition.

The work pieces have been pretreated in the following manner before their use for the nickel deposition:

i) Degreasing by hot soak cleaner ii) Electrolytic degreasing iii) Rinsing, iv) Acid dipping with 10 vol % sulfuric acid Sample work pieces, made of copper and brass, have been scratched for subjective optical judgment of leveling. The glance of the resulting nickel deposits on the work pieces has been also judged optically.

All results shown in Tables 1 and 2 for leveling and glance are qualitatively ranked having the following synonyms:

| | |
|---|---|
| +++ | Excellent |
| ++ | Good |
| + | Medium |
| – | Bad |

All concentrations given in Tables 1 and 2 for the different bath components are listed in mg/l, if not stated differently. The basic electroplating bath components (Watts's bath) are listed above and will not be repeated in the Tables, even if they are of course comprised. Golpanol DEP (N,N-Diethyl-2-propyne-1-amine), Golpanol PME (propargyl alcohol ethoxylate), Golpanol BOZ (2-Butyne-1,4-diol), and Golpanol HD (3-Hexyne-2,5-diol) are commercially available brighteners.

The experiments given in Tables 1 and 2 are numbered in consequent order wherein the second number in parentheses is an internal experiment number of the applicant.

Turning now to the Tables, Table 1 shows conducted experiments for semi-bright nickel coatings mostly in accordance with embodiments of the present invention.

TABLE 1

Experiments for semi-bright nickel coatings

| Exp. | Bath | Leveling | Glance |
|---|---|---|---|
| 1 (3) | 1 PME | +++ | ++ |
| 2 (4) | 1 DEP | +++ | ++ |
| 3 (5) | 5 BOZ | +++ | ++ |
| 4 (6) | 5 PME | +++ | ++ |
| 5 (7) | 5 DEP | +++ | ++ |
| 6 (8) | 25 BOZ | +++ | ++ |
| 7 (9) | 15 PME | +++ | ++ |
| 8 (10) | 15 DEP | +++ | ++ |
| 9 (11) | 75 BOZ | +++ | ++ |
| 10 (12) | 2 PME<br>2 DEP<br>10 BOZ | +++ | ++ |
| 11 (13) | 4 PME<br>4 DEP<br>20 BOZ | +++ | +++ |
| 12 (14) | 3 PME<br>3 DEP<br>15 BOZ | +++ | +++ |

TABLE 1-continued

| Experiments for semi-bright nickel coatings | | | |
|---|---|---|---|
| Exp. | Bath | Leveling | Glance |
| 13 (15) | +37.5 chloral hydrate (80 chloral hydrate in total) 3 PME 3 DEP 15 BOZ | +++ | +++ |
| 14 (16) | 10 HD | +++ | +++ |

Table 2 exhibits experiments for semi-bright nickel coatings in accordance with comparative embodiments outside of the present invention wherein no acetylenic compounds have been added to the electroplating bath (experiments 15 and 16) and in Table 1, experiment 13, which exhibits a total concentration of 80 mg/l of chloral hydrate, constituting also a comparative example.

While for the experiments 1 to 14 according to embodiments of the present invention (experiment 13 is a comparative example) the glace values are either good or excellent, the comparative experiment 15 exhibit often good results in respect to leveling, but at the same time the glance value is bad.

TABLE 2

| Comparative experiments for semi-bright nickel coatings | | | |
|---|---|---|---|
| Exp. | Bath | Leveling | Glance |
| 15 (V5, 1) | No additional components | +++ | – |
| 16 (2) | +37.5 Chloralhydrat (80 Chloralhydrat in total) | +++ | ++ |

A special surprising effect of a preferred embodiment of the present invention shall be outlined by a direct comparison of experiments 1 to 14 with the comparative experiment 15. In comparative experiment 15 no acetylenic compounds have been added to the electroplating bath as additives. In contrast in experiments 1 to 14 Golpanol DEP, Golpanol PME, Golpanol BOZ, and/or Golpanol HD have been added as acetylenic additives in various combinations resulting in a good or excellent glance value, which is in contrast to the bad glance value for comparative experiment 15.

Further, it is emphasized that a direct comparison between comparative experiment 13 and comparative experiment 16 reveals, that the addition of 3 mg/l Golpanol PME, 3 mg/l Golpanol DEP and 15 mg/l Golpanol BOZ as acetylenic compounds results in an improvement of the glance value from good (see comparative example 16) to excellent (see example 13). However, this is achieved in the presence of a comparatively high concentration of chloral hydrate, i.e. 80 mg/l.

In particular, it is emphasized that a direct comparison between experiment 14 and comparative experiment 15 reveals, that the addition of 10 mg/l Golpanol HD as acetylenic compound results in an improvement of the glance value from bad (see comparative example 15) to excellent (see example 14). This was achieved in the presence of a comparatively low concentration of chloral hydrate, i.e. 42.5 mg/l, which was unforeseeable.

Thus, in respect to experiments 12 and comparative experiment 13, it has to be emphasized that an excellent glance value has been achieved by adding specific concentrations of acetylenic compounds, while at the same time the concentration of chloral hydrate could be reduced to 42.5 mg/l (see experiment 12 versus comparative experiment 13) without reducing the glance value, since in both experiment 12 and comparative experiment 13 the glance value is excellent.

Consequently, a significant reduction of the concentration of chloral hydrate within the electroplating bath can be achieved without impairing the levelling and glance value of the semi-bright nickel or semi-bright nickel alloy coating, so that the manufacturing costs could be significantly reduced.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the appended claims.

The invention claimed is:

1. Galvanic nickel or nickel alloy electroplating bath for depositing a semi-bright nickel or semi-bright nickel alloy coating, wherein the electroplating bath comprises at least one compound having the general formula (I) and/or a salt thereof (I)

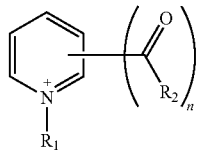

wherein $R_1$=$C_1$-$C_{18}$ hydrocarbon moiety comprising a $SO_3^-$ group, or $C_1$-$C_{18}$ hydrocarbon moiety comprising a carboxylic group, or $C_1$-$C_{18}$ hydrocarbon moiety comprising an aromatic and/or a heteroaromatic group;

$R_2$=$NR_3R_4$ moiety, or $OR_5$ moiety, or cyclic $NR_6$ moiety, wherein $R_3$, $R_4$, $R_5$=hydrogen, or $C_1$-$C_{18}$ aliphatic hydrocarbon moiety, or $C_1$-$C_{18}$ hydrocarbon moiety comprising an aromatic and/or a heteroaromatic group, wherein $R_3$, $R_4$ and $R_5$ are identical or different;

$R_6$=$C_3$-$C_8$ hydrocarbon moiety, or $C_3$-$C_8$ hydrocarbon moiety wherein at least one carbon atom is substituted by a heteroatom;

n=1-3; and characterized in that the electroplating bath further comprises at least one acetylenic compound at a total concentration ranging from 0.002 g/l to 0.15 g/l and/or a salt thereof, wherein the at least one acetylenic compound and/or a salt thereof is selected from the group consisting of H—C≡C—$CH_2$—N(ethyl)$_2$, H—C≡C—$CH_2$—O—$CH_2$—$CH_2$—OH, $CH_3$—CH(OH)C≡C—CH(OH)—$CH_3$, $CH_3$—C($CH_3$)(OH)—C≡C—C($CH_3$)(OH)—$CH_3$, HO—$CH_2$—C≡C—$CH_2$—OH, HO—$CH_2$—$CH_2$—O—$CH_2$—C≡C—$CH_2$—O—$CH_2$—$CH_2$—OH, H—C≡C—$CH_2$—O—$CH_2$—$CH_2$—$CH_2$—OH, and HO—$CH_2$—C≡C—$CH_2$—O—$CH_2$—$CH_2$—$CH_2$—OH, and wherein the electroplating bath comprises chloral hydrate, wherein the chloral hydrate has a concentration of less than 0.07 g/l.

2. Galvanic nickel or nickel alloy electroplating bath according to claim 1 characterized in that the electroplating bath comprises the at least one acetylenic compound and/or a salt thereof at a total concentration ranging from 0.003 g/l to 0.1 g/l.

3. Galvanic nickel or nickel alloy electroplating bath according to claim 1 characterized in that the electroplating bath comprises chloral hydrate at a concentration less than 0.045 g/l.

4. Galvanic nickel or nickel alloy electroplating bath according to claim 1 characterized in that the electroplating bath comprises additionally at least one bright nickel additive and/or a salt thereof.

5. Galvanic nickel or nickel alloy electroplating bath according to claim 1 characterized in that the electroplating bath does not comprise formaldehyde or does comprise formaldehyde at a concentration less than 0.1 g/l.

6. Galvanic nickel or nickel alloy electroplating bath according to claim 1 characterized in that the electroplating bath does not comprise an aromatic sulfonic acid and/or a salt thereof, and/or that the electroplating bath does not comprise benzoic acid sulfimide.

7. Galvanic nickel or nickel alloy electroplating bath according to claim 1 characterized in that the electroplating bath further comprises at least one compound selected from internal stress reducers and/or salts thereof, wherein the at least one internal stress reducer comprises salicylic acid and/or a salt thereof.

8. Galvanic nickel or nickel alloy electroplating bath according to claim 7 characterized in that the salicylic acid and/or a salt thereof has a total concentration ranging from 0.5 g/l to 3.5 g/l.

9. Method for depositing a semi-bright nickel or semi-bright nickel alloy coating on an electrically conductive work piece comprising the following method steps:

i) Bringing the work piece into contact with a galvanic nickel or nickel alloy electroplating bath according to claim 1;

ii) Bringing at least one anode into contact with the galvanic nickel or nickel alloy electroplating bath;

iii) Applying a voltage across the work piece and the at least one anode; and iv) Electrodepositing a semi-bright nickel or semi-bright nickel alloy coating on the work piece.

10. Galvanic nickel or nickel alloy electroplating bath according to claim 1 characterized in that the electroplating bath comprises the at least one acetylenic compound and/or a salt thereof at a total concentration ranging from 0.004 g/l to 0.08 g/l.

11. Galvanic nickel or nickel alloy electroplating bath according to claim 1 characterized in that the electroplating bath comprises formaldehyde at a concentration less than 0.005 g/l.

12. Galvanic nickel or nickel alloy electroplating bath according to claim 1 characterized in that the electroplating bath does not comprise formaldehyde.

* * * * *